US006520052B1

(12) United States Patent
Saunders et al.

(10) Patent No.: US 6,520,052 B1
(45) Date of Patent: Feb. 18, 2003

(54) OIL FILTER WRENCH

(75) Inventors: James Saunders, Memphis, TN (US); Scott Webb, Memphis, TN (US)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 221 days.

(21) Appl. No.: 09/590,121

(22) Filed: Jun. 9, 2000

Related U.S. Application Data

(63) Continuation of application No. 09/173,417, filed on Oct. 16, 1998, now abandoned.

(51) Int. Cl.[7] ..... B25B 13/52
(52) U.S. Cl. ..... 81/64; 81/3.43
(58) Field of Search ..... 81/3.43, 64

(56) References Cited

U.S. PATENT DOCUMENTS

| | | | | |
|---|---|---|---|---|
| 590,710 | A | | 9/1897 | Sheppard |
| 737,404 | A | | 8/1903 | Harrison |
| 771,376 | A | * | 10/1904 | Loxterkamp ..... 81/64 |
| 1,416,673 | A | | 5/1922 | Baldwin |
| 1,458,140 | A | | 6/1923 | Lewis |
| 1,953,238 | A | | 4/1934 | Kosanovich |
| 2,132,207 | A | | 10/1938 | Donovan |
| 2,317,037 | A | | 4/1943 | Donovan |
| 2,417,741 | A | | 3/1947 | Dillon |
| 2,458,329 | A | | 1/1949 | Archer |
| 2,674,911 | A | | 4/1954 | Theis |
| 2,780,951 | A | * | 2/1957 | Bram ..... 81/64 |
| 3,084,573 | A | | 4/1963 | Lipski |
| 4,007,650 | A | | 2/1977 | Wellman |
| 4,150,592 | A | | 4/1979 | Mott |
| D268,164 | S | | 3/1983 | Sandberg |
| 4,660,445 | A | | 4/1987 | Windom |
| 4,889,018 | A | | 12/1989 | Shaffer |
| D307,101 | S | | 4/1990 | Anderson |
| 5,056,383 | A | * | 10/1991 | Halpin ..... 81/64 X |
| 5,065,648 | A | | 11/1991 | Hocfhaum |
| 5,390,570 | A | | 2/1995 | Reisner |
| D365,259 | S | | 12/1995 | Littlejohn |

* cited by examiner

*Primary Examiner*—James G. Smith
(74) *Attorney, Agent, or Firm*—Joseph J. Previto

(57) ABSTRACT

An oil filter wrench comprising a gripping strap having an inner and outer surface, a handle for tightening the gripping strap. Gripping fingers extending inwardly from the gripping strap, each gripping finger being round and symmetrical and having a smooth convex gripping inner surface and a smooth concave outer surface. The fingers are provided on the strap in spaced relationship to each other in clusters of nine at spaced intervals around the strap, arranged in parallel rows of three each.

4 Claims, 3 Drawing Sheets

OIL FILTER WRENCH

This patent application is a continuation of patent application, Ser. No. 09/173,417 filed Oct. 16, 1998 now abandoned.

BACKGROUND

The present invention relates to an oil filter wrench and more particularly to an oil filter wrench which has improved gripping characteristics.

Oil filter wrenches usually comprise a circular strap mounted on a handle or a pair of handles. Each end of the strap is mounted at offset portions on the handle so that when the strap is placed over an oil filter and the handle rotated, the strap of the wrench will tighten and grasp the body of the oil filter. This facilitates the threadable mounting on and removal of the oil filter from a vehicle. Such oil filter wrenches have been used for many years. Some of the wrenches are smooth on the inside of the gripping strap, which sometimes causes slippage, especially if the wrench or the oil filter is oily. Attempts to avoid this problem have included punching inwardly facing holes in the strap so that the jagged edges of the holes will bite into the body of the oil filter to grasp it tightly. However, such jagged edges may damage the oil filter.

OBJECTS

The present invention avoids these problems and has for one of its objects the provision of an improved oil filter wrench which is adapted to firmly grasp an oil filter to permit it to be threadably attached to or removed from a vehicle.

Another object of the present invention is the provision of an improved oil filter wrench in which the gripping portions of the wrench are equally distributed around the gripping strap in order to permit uniform gripping.

Another object of the present invention is the provision of an improved oil filter wrench in which the gripping portions of the wrench are so arranged with respect to each other as to give the best gripping results.

Another object of the present invention is the provision of an improved oil filter wrench in which the gripping portions of the wrench are so structured that they will not damage the body of the oil filter while at the same time grasping it firmly.

Other and further objects will be obvious upon the understanding of the illustrative embodiment about to be described, or which will be indicated in the appended claims, and various advantages not referred to herein, will occur to one skilled in the art upon embodiment of the invention in practice.

DRAWINGS

A preferred embodiment of the invention has been chosen for purposes of illustration and description and is shown in the accompanying drawings forming a part of specification wherein.

DESCRIPTION

Figure 1:
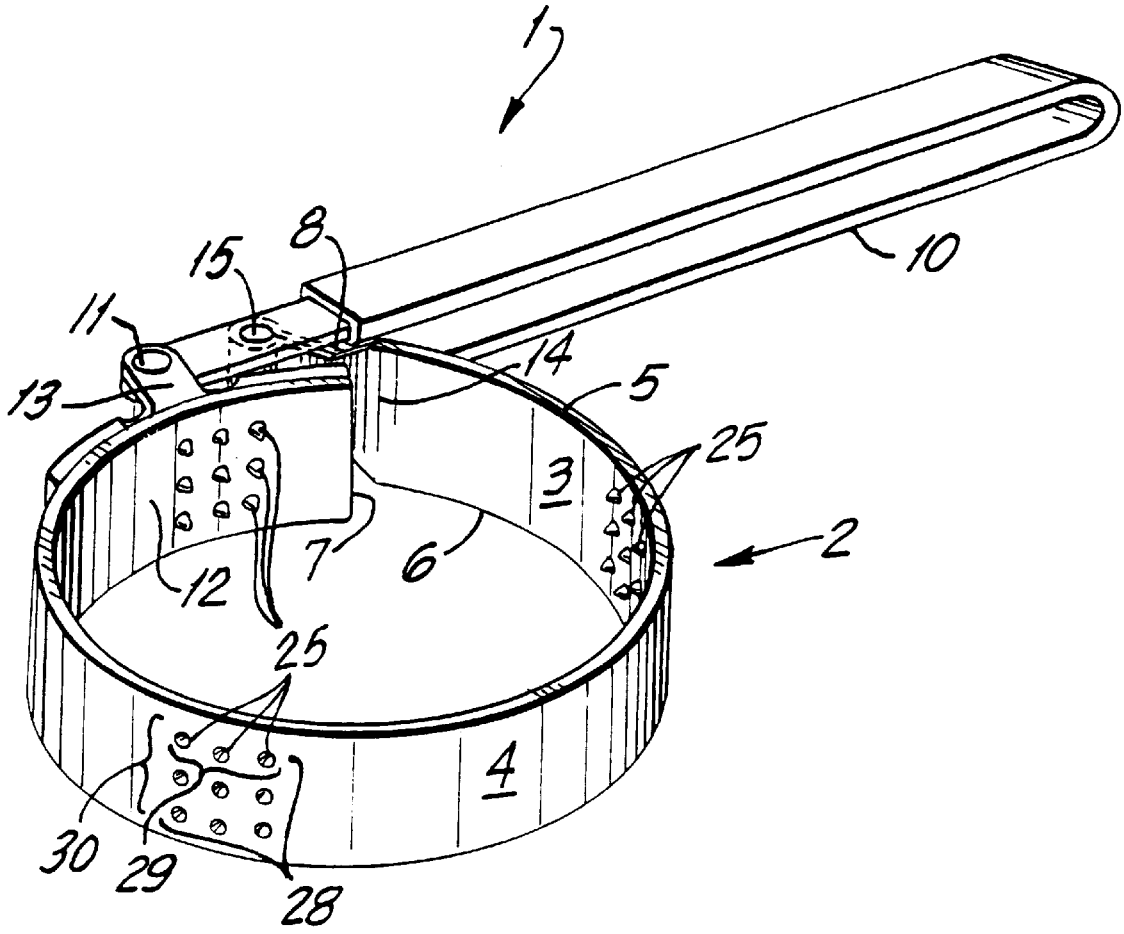
FIG. 1 is a perspective view of an oil filter wrench made in accordance with the present invention.

Referring to the drawing, and more particularly FIG. 1 the oil filter wrench 1 of the present invention comprises a gripping strap 2 (preferably made of metal) having an inner face 3, an outer face 4 and top and bottom edges 5 and 6. The strap 2 has a pair of end edges 7 and 8 which are not attached to each other.

Figure 2:
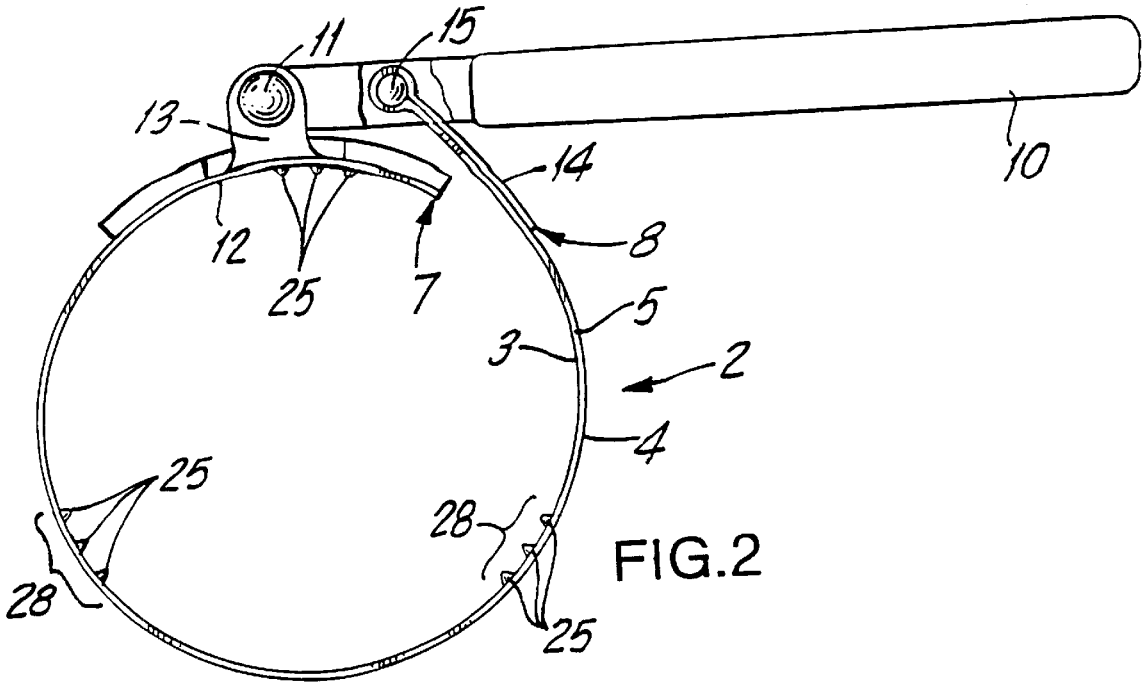
FIG. 2 is a top view thereof.

A handle 10 is provided onto which the strap 2 is attached. The handle 10 has spaced pivots 11 and 15. One end 12 of the strap 2 is pivotally mounted to the pivot 11 by means of attachment member 13. The other end 14 of the strap 3 is wrapped around the pivot 15 which is spaced from pivot 11. In other words, the strap 2 is pivoted at its two opposite ends 12–14 at pivots 11–15 which are spaced from each other. It will be seen that when the handle 10 is in a first position (FIG. 2) the two ends 12–14 of the strap 2 are spaced from each other and the strap 2 is in its open position. However, when the handle 10 is moved or rotated in the opposite it will be understood that the present invention may be used with other types of oil filter wrenches.

Figure 4:
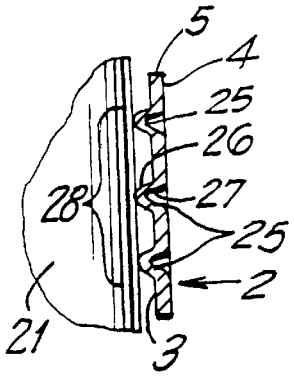
FIG. 4 is a sectional view taken along line 4—4 of FIG. 3.
Figure 3:
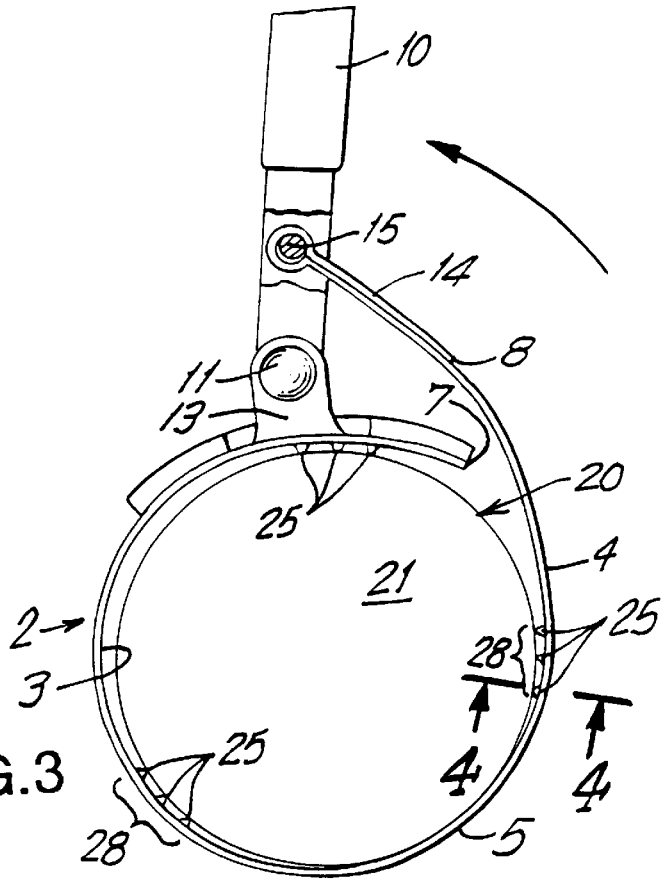
FIG. 3 is a view similar to FIG. 2 showing the manner in which the wrench is applied to an oil filter.
Figure 5:
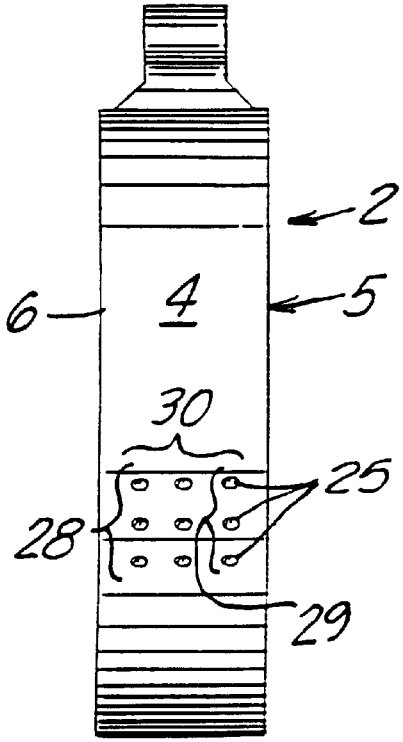
FIG. 5 is a front elevational view of the strap of the oil filter wrench, with the handle removed for simplicity.
Figure 6:
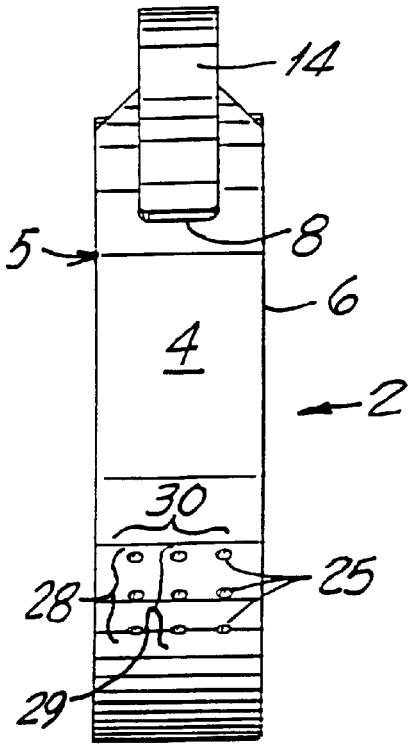
FIG. 6 is a rear elevational view thereof.
Figure 7:
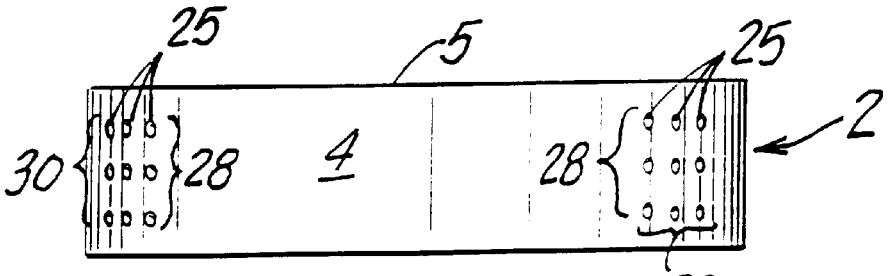
FIG. 7 is a bottom elevational view thereof.
Figure 8:
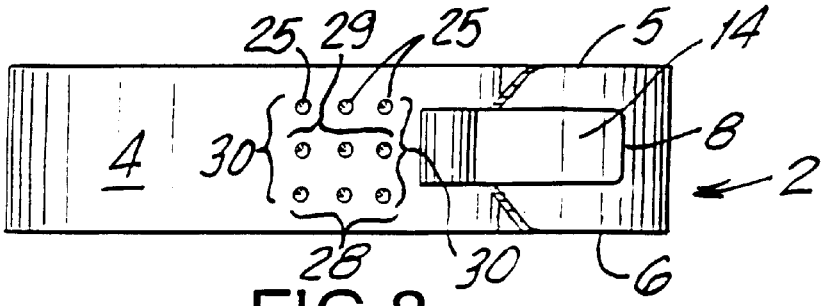
FIG. 8 is a top elevational view thereof.

The strap 2 has a plurality of gripping indentations or fingers 25 formed therein. Each gripping finger 25 is formed by pushing the outer surface of the strap 3 inwardly so that the finger 25 extends inwardly from the inner face 3 of the strap 2. The fingers 25 may be formed in any desired or conventional manner by pushing the outer face 4 of the strap 2 inwardly at predetermined spots to form each of the fingers 25 extending inwardly from inner face 3. Each finger 25 is round and symmetrical, as shown in FIG. 4, and has a smooth, convex gripping inner surface 26 facing inwardly from the inner face 3 of the strap 2 and a smooth concave outer surface 27 pointing inwardly from the outer face 4 at the strap 2. The fingers 25 do not have any jagged edges or holes in them nor do they have any sharp pointed edges. In this manner, when the fingers 25 grip the outer wall 20 of the oil filter 21, there is no danger of damaging the oil filter.

It has been determined that a cluster 28 of nine of these gripping fingers 25 grouped in three-by-three formation, as shown in the drawing, give the best gripping results without danger of slippage or damage to the oil filter. The nine gripping fingers 25 in each cluster 28 are preferably formed in three parallel rows 29 and 30 of three fingers 25 each which are perpendicular to each other. The rows 29–30 forming the clusters 28 are preferably perpendicular and parallel to the top and bottom edges 5–6 of the strap 2 in the two directions in which they extend. In other words, each row 29 of gripping fingers 25 in each cluster 28 is parallel to the edges 5–6 and each row 30 is perpendicular to edges 5–6.

The gripping finger clusters 28 are disposed substantially equidistant from each other around the strap 2. In the embodiment shown in the drawings, three clusters 28 of gripping fingers 25 are shown as being in the most effective location for gripping the outer wall 20 of an oil filter 21 at three different substantially equidistant areas. It will be understood that the orientation of these clusters 28 may differ without departing from the invention and that the number of fingers 25 in each clusters 28 may also differ from that disclosed without departing from the invention.

It will thus be seen that the present invention provides an improved oil filter wrench which is adapted to firmly grasp an oil filter to permit it to be thereadably attached to or removed from an automobile, in which the gripping portions of the wrench are equally distributed around the gripping strap in order to permit uniform gripping, in which the gripping portions of the wrench are so arranged with respect to each other as to give the best gripping results and in which the gripping portions of the wrench are so structured that they will not damage the body of the oil filter while at the same time grasping it firmly.

As may varied modifications of the subject matter of this invention will become apparent to those in the art from the detailed description given hereinabove, it will be understood that the present invention is limited only as provided in the claims appended hereto.

The embodiment of the invention in which an exclusive property or privilege is claimed are defined as follows:

1. An oil filter wrench comprising a one piece gripping strap having an inner and outer surface, said strap being one uninterrupted piece from said inner to said outer surface, means for tightening the gripping strap, gripping means extending inwardly from the one piece gripping strap and being integral therewith, said gripping means comprising a plurality of one piece rigid gripping fingers integral and one piece with and extending inwardly from the inner surface of the one piece gripping strap, each of said gripping fingers being substantially round and symmetrical, and each of said gripping fingers having a substantially smooth and uninterrupted convex gripping inner surface, each of said fingers extending from the outer surface to the inner surface of the strap, each of said gripping fingers comprising a concave surface extending inwardly from the outer surface of the strap and a convex surface extending away from the inner surface of said strap, a plurality of said gripping fingers being provided on the strap in spaced relationship to each other, said plurality of said gripping fingers comprising a cluster of said fingers at spaced intervals around said strap, each cluster of fingers comprising a plurality of said fingers, said tightening means comprising the strap having a pair of end edges with the end edges mounted on a handle at pivoted points on said handle which are spaced from each other a plurality of said clusters are provided around the strap in equidistant relationship to each other, each cluster comprising a plurality of rows of fingers, said rows are parallel to an edge of the strap and the rows of fingers are parallel to each other.

2. An oil filter wrench as set forth in claim 1 wherein said cluster comprise three rows of fingers parallel to each other.

3. An oil filter wrench as set forth in claim 2 wherein each row comprises three fingers.

4. An oil filter wrench as set forth in claim 3 wherein three clusters of gripping fingers are provided on said strap in equidistant relationship to each other.

* * * * *